US006878008B2

(12) United States Patent
Brancaleone

(10) Patent No.: US 6,878,008 B2
(45) Date of Patent: Apr. 12, 2005

(54) CABLE CONNECTOR

(75) Inventor: Salvatore T. Brancaleone, Trabuco Canyon, CA (US)

(73) Assignee: Sabritec, Inc., Irvine, CA (US)

( * ) Notice: Subject to any disclaimer, the term of this patent is extended or adjusted under 35 U.S.C. 154(b) by 0 days.

(21) Appl. No.: 10/832,637

(22) Filed: Apr. 27, 2004

(65) Prior Publication Data

US 2004/0203285 A1 Oct. 14, 2004

Related U.S. Application Data

(63) Continuation of application No. 10/190,310, filed on Jul. 3, 2002.

(60) Provisional application No. 60/302,865, filed on Jul. 3, 2001.

(51) Int. Cl.[7] ..... H01R 13/58

(52) U.S. Cl. ..... 439/457; 439/582; 29/748

(58) Field of Search ..... 439/457, 582, 439/456, 458, 459; 29/748, 860

(56) References Cited

U.S. PATENT DOCUMENTS

| | | | | | |
|---|---|---|---|---|---|
| 5,848,916 | A | * | 12/1998 | Huang | 439/619 |
| 6,017,242 | A | | 1/2000 | Kerrigan | |
| 6,257,921 | B1 | * | 7/2001 | Kuo et al. | 439/457 |
| 6,340,312 | B1 | * | 1/2002 | Ko | 439/582 |
| 6,375,493 | B1 | * | 4/2002 | Lin | 439/457 |
| 6,419,521 | B2 | * | 7/2002 | Kanagawa et al. | 439/582 |

* cited by examiner

*Primary Examiner*—Gary Paumen
(74) *Attorney, Agent, or Firm*—Knobbe, Martens, Olson & Bear LLP

(57) ABSTRACT

A cable connector having a body, a connection means, and a support member. A cable or wire runs through the body and to the connection means. The connection means allows the cable connector to removably engage a device designed to accept a cable. The support member provides lateral support to the cable. The support member prevents excessive forces from reaching a device to which the cable connector is attached by resisting or absorbing, rather than transmitting, such forces.

2 Claims, 4 Drawing Sheets

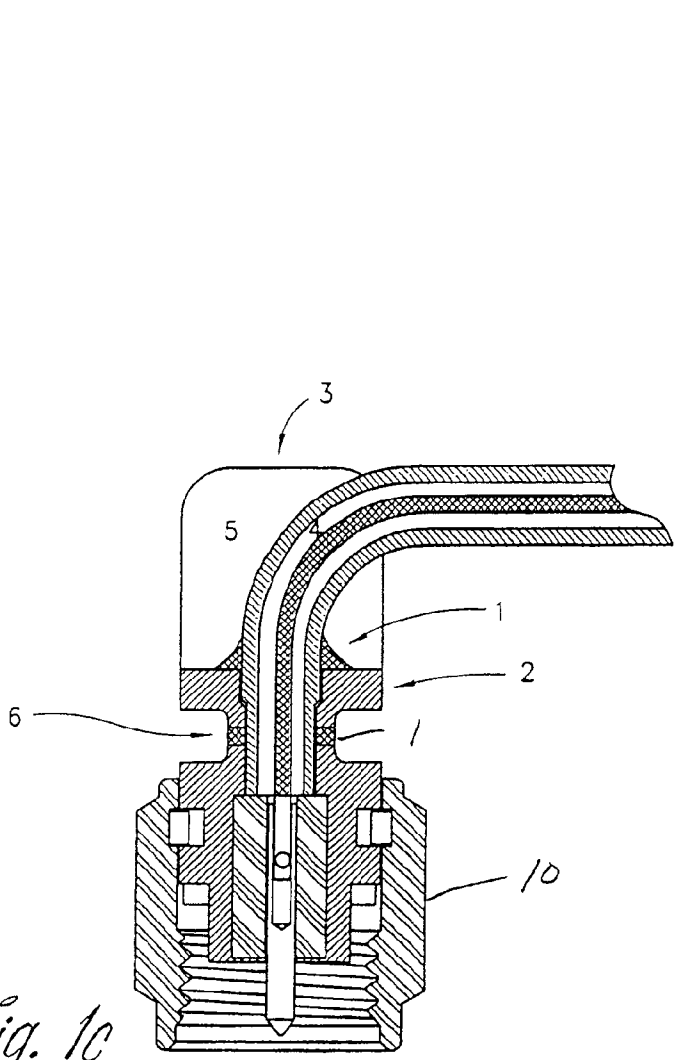
Fig. 1c
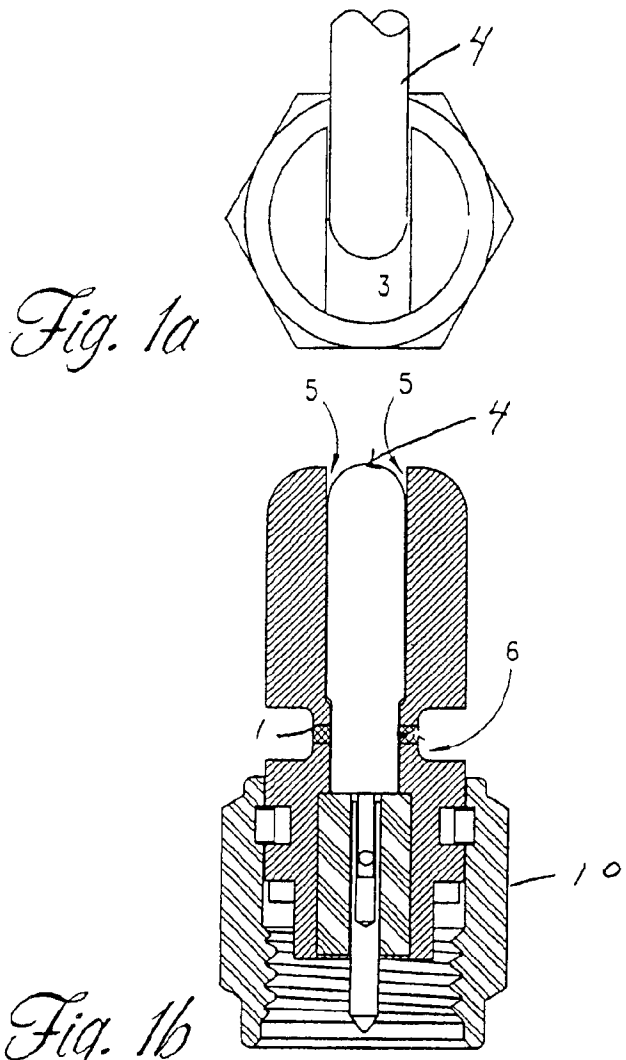
Fig. 1a
Fig. 1b

CABLE CONNECTOR

PRIORITY CLAIM

This application is a continuation of U.S. application Ser. No. 10/190,310, Filed Jul. 3, 2002 which claims the benefit of U.S. Provisional Application No. 60/302,865 filed Jul. 3, 2001 entitled "CABLE CONNECTOR".

BACKGROUND OF THE INVENTION

Field of the Invention

This invention relates to electrical connectors and particularly to rigid or semi-rigid coaxial cable connections where the cable bends ninety degrees just beyond the connection.

SUMMARY OF THE INVENTION

Certain transmission applications, such as high performance radio frequency transmission, use rigid or semi-rigid coaxial cable assemblies. Quite often the cable must bend ninety degrees just beyond the cable connection. Because the rigid cable can act as a lever focusing torque forces on the cable connection; normal handling of these cable assemblies can cause the solder joint to fail in shear.

The preferred embodiments of the present invention provide a solution to this problem with the addition of a stabilizing support member. The support member has a slot advantageously cut just wider than the coaxial cable, creating two parallel surfaces to bear the torque forces that would otherwise be applied to the solder joint. One aspect of a preferred embodiment is that the slot gives support to the coaxial cable through a substantial portion of the ninety degree bend. Another aspect of a preferred embodiment is a solid support member integral to the connector body. Still another aspect of a preferred embodiment is a radial groove below the support member that provides access to the outer conductor, allowing the solder to flow to all regions of the junction.

BRIEF DESCRIPTION OF THE DRAWINGS

FIG. 1(A) shows a top elevation view of one embodiment of the cable connector with a coaxial cable connected.

FIGS. 1(B) and 1(C) show cross-section views of one embodiment of the cable connector with a coaxial cable connected;

DETAILED DESCRIPTION OF THE PREFERRED EMBODIMENT

Figure 2C:
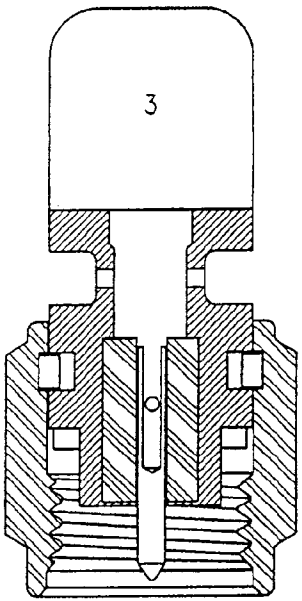
FIGS. 2(B) and 2(C) show cross-section views of one embodiment of the cable connector without a coaxial cable connected.
Figure 2A:
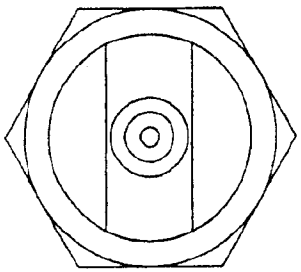
FIG. 2(A) shows a top elevation view of one embodiment of the cable connector without a coaxial cable connected.
Figure 2B:
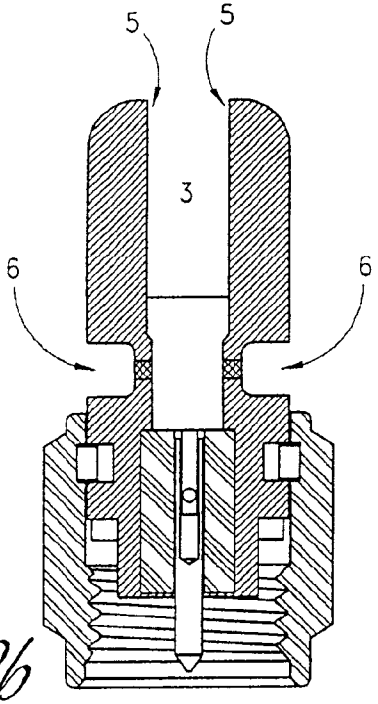
Figure 3:
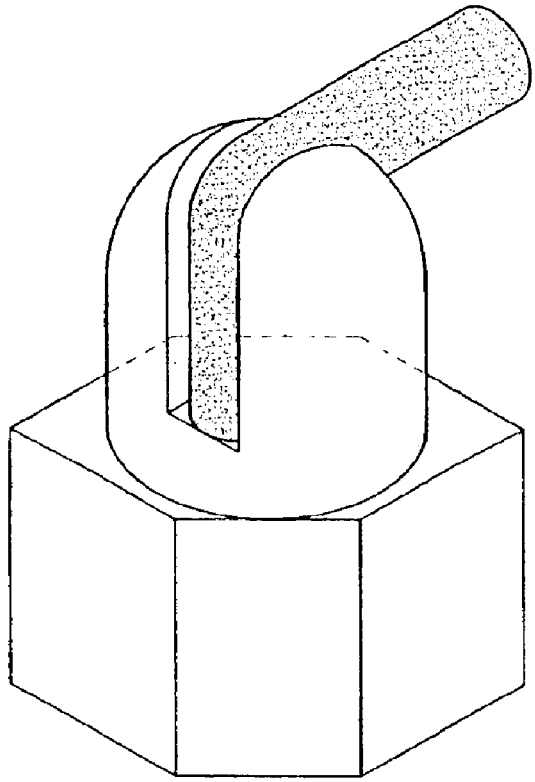
FIG. 3 illustrates a perspective view of the cable connector with a coaxial cable connected.
Figure 4:
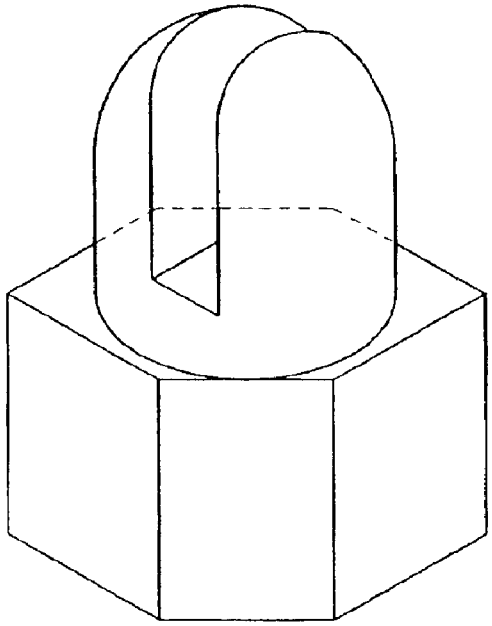
FIG. 4 illustrates a perspective view of the cable connector without a coaxial cable connected.

In rigid or semi-rigid coaxial cable systems, commonly used for transmission of radio frequency signals, it is often necessary to bend the cable immediately upon exiting the connector assembly due to space and positioning constraints. Normal handling of these assemblies frequently causes failure since large torque loads can be concentrated on the solder joint. A solder joint alone is not sufficient to handle the large loads and can fail in shear. This requires repairs or replacement of the connector which can be costly and time consuming.

The preferred embodiments of this invention solve this shear failure problem. FIGS. 1(A), 1(B), and 1(C) show one preferred embodiment of the connector body 2 with a coaxial cable 4 connected. The cable connector includes a threaded member 10 attached to the outside of the connector body 2 for securing the connector to a mating female connector (not shown). The coaxial cable 4 interferingly engages within the body of the connector and is secured in place by a solder joint 1.

The connector body 2 has an integrated solid support member 3 which extends upward with a slot cut out of the member forming two parallel surfaces 5 to allow passage of the cable 4 out from the connector. This slot is advantageously just wider than the cable so that the parallel surfaces 5 substantially enclose the cable 4 through the ninety degree bend. In the preferred embodiments, the support member 3 has a cylindrical cross-section and a rounded top surface, but it will be apparent that alternative cross-sections and shapes can be employed as long as the support surfaces 5 are sized to give lateral support to the cable 4 through a substantial portion of the cable bend.

The support member 3 protects the solder joint 1 from failing in the shear during normal handling of the connector. When a wrenching force is applied on the cable 4 the support member 3 stabilizes the cable near the connection and allows the support member 4 and connector body 2 to bear the torque rather than the solder joint 1.

The preferred embodiments further include a radial groove 6 located just below the support member 3. This groove 6 provides access to the cable outer conductor for allowing the solder 1 to flow to all regions of the junction.

What is claimed is:

1. A method for preventing shear failure when a cable is bent upon exiting from an electrical connector, said connector having a radial groove providing access to said cable, comprising:

leading said cable between a pair of juxtaposed walls just wider than the external diameter of said cable, said walls limiting bending of said cable where said cable is attached to said connector to substantially a single plane; and flowing solder through said radial groove to between said cable and the body of said electrical connector.

2. A method for preventing shear failure when a cable is bent upon exiting from an electrical connector comprising leading said cable between a apir of juxtaposed walls just wider than the external diameter of said cable, said walls limiting bending of said cable where said cable is attached to said connector to substantially a single plane, and attaching said cable to said electrical connector by flowing solder through a radial groove below said pair of juxtaposed walls.

* * * * *

UNITED STATES PATENT AND TRADEMARK OFFICE

CERTIFICATE OF CORRECTION

PATENT NO. : 6,878,008 B2
APPLICATION NO. : 10/832637
DATED : April 12, 2005
INVENTOR(S) : Salvato Brancaleone It is certified that error appears in the above-identified patent and that said Letters Patent is hereby corrected as shown below:

At column 2, line 56, please delete “apir” and insert --pair--

Signed and Sealed this

First Day of August, 2006

JON W. DUDAS
*Director of the United States Patent and Trademark Office*